US007326100B2

(12) United States Patent
O'Brien

(10) Patent No.: US 7,326,100 B2
(45) Date of Patent: Feb. 5, 2008

(54) MARBLE BUILDING TOY

(76) Inventor: Gilford O'Brien, 100 S. Baldwin, Suite 108, Madison, WI (US) 53703

( * ) Notice: Subject to any disclaimer, the term of this patent is extended or adjusted under 35 U.S.C. 154(b) by 0 days.

(21) Appl. No.: 11/233,880

(22) Filed: Sep. 23, 2005

(65) Prior Publication Data

US 2006/0189248 A1 Aug. 24, 2006

Related U.S. Application Data

(60) Provisional application No. 60/654,351, filed on Feb. 18, 2005.

(51) Int. Cl.
*A63H 3/46* (2006.01)
*A63H 3/04* (2006.01)
*A63H 33/04* (2006.01)

(52) U.S. Cl. ..... 446/97; 403/57; 446/102; 446/111; 446/120; 446/383

(58) Field of Classification Search ..... 446/85, 446/97, 102, 104, 111, 116, 120, 124, 125; 403/57; 464/139, 141, 142, 151
See application file for complete search history.

(56) References Cited

U.S. PATENT DOCUMENTS 751,273 A * 2/1904 Fahrney et al. ..... 285/127.2
4,548,590 A * 10/1985 Green ..... 446/120
4,719,737 A 1/1988 Swart
5,172,534 A * 12/1992 Milner et al. ..... 52/632
5,175,913 A 1/1993 Mackie
5,180,323 A 1/1993 Justice
5,222,902 A 6/1993 Piersch
5,518,434 A 5/1996 Ziegler
5,545,070 A 8/1996 Liu
5,769,681 A * 6/1998 Greenwood et al. ..... 446/120
5,897,417 A * 4/1999 Grey ..... 446/125
5,964,635 A * 10/1999 Krog ..... 446/120
6,325,694 B1 * 12/2001 Clever et al. ..... 446/104
6,948,998 B2 * 9/2005 Bagley ..... 446/124

* cited by examiner

*Primary Examiner*—John A. Ricci
(74) *Attorney, Agent, or Firm*—DeWitt Ross & Stevens S.C.; Charles S. Sara

(57) ABSTRACT

This application discloses a toy construction apparatus that can be used to make posable toy figures. The apparatus includes structural pieces, called "bones," which can be connected to a plurality of other bones by joints that can be formed by a marble or similar device and connecting structures on the ends of each bone. These joints can either be movable or rigid depending on the type of connecting structures on the end of each bone being connected by the joint. Additionally, specialized structures, such as heads, feet, and torsos, can be used with the toy construction apparatus that allow the user to create more complex and life-like toy figures.

10 Claims, 17 Drawing Sheets

MARBLE BUILDING TOY

CROSS REFERENCE TO RELATED APPLICATIONS

This application claims benefit and priority from provisional application No. 60/654,351 filed on Feb. 18, 2005, entitled, "Marble Building Toy," which is incorporated by reference herein in its entirety.

BACKGROUND OF THE INVENTION

1. Field of the Invention

The present invention is directed to a toy design that allows a user to build posable toy figures from rigid structural pieces referred to as "bones" that can be connected to other bones by either movable or rigid joints. These joints are formed by connecting structures on at least one end of each bone that can both be connected to a marble or other similar spherical or spheroidal workpiece.

2. Description of the Related Art

U.S. Pat. No. 5,545,070 to Liu, has an issue date of Aug. 13, 1996. The patent discloses planar blocks with edge apertures and hinged connectors. The planar blocks can fit into each other by locking one side to the other side. The blocks can also snap onto each other front/back as well.

SUMMARY OF THE INVENTION

It is an aspect of the present invention to provide an apparatus that can be used as a toy construction set, which includes rigid structural pieces connected by both movable and rigid joints that also contain a marble or similar spherical or spheroidal device.

The above aspects can also be attained by an apparatus that includes a plurality of structural pieces, each having a first end and a second end; a first u-shaped yoke or split yoke at the first end and a second U-shaped yoke or split yoke at a second end; a marble or other spherical workpiece, or a spheroidal midsection, capable of being received by a u-shaped yoke, two split yokes, or a similar connecting apparatus.

These, together with other aspects and advantages, which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
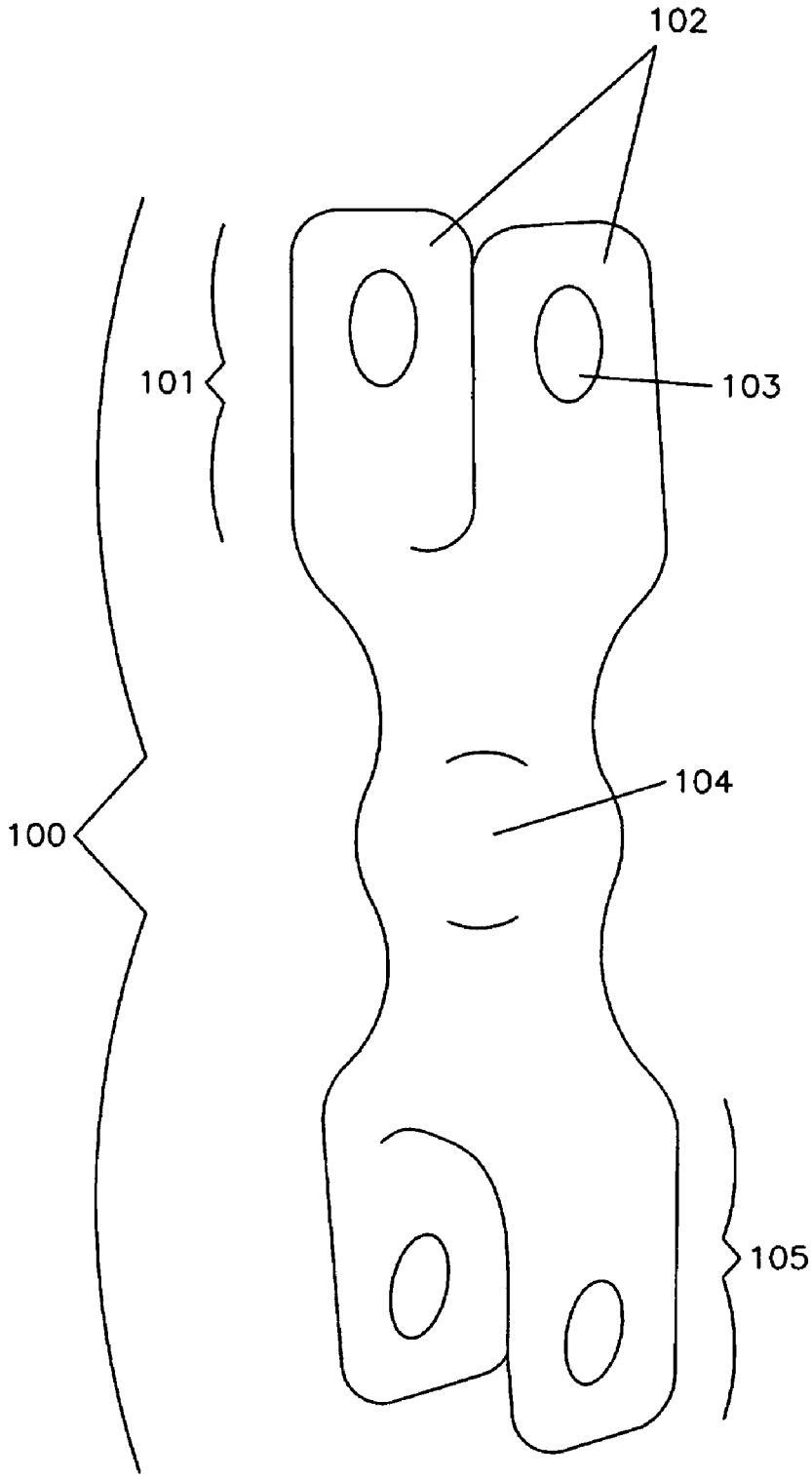
FIG. 1 is a drawing illustrating a perspective view of a structural workpiece, referred to hereafter as a "bone," the bone has a first end that includes a first u-shaped yoke and a second end including a second u-shaped yoke, the first u-shaped yoke being on the same plane as the second unshaped yoke, according to an embodiment.

Reference will now be made in detail to the presently preferred embodiments of the invention, examples of which are illustrated in the accompanying drawings, wherein like reference numerals refer to like elements throughout.

The present general inventive concept relates to a construction toy apparatus for building objects from structural workpieces, called "bones," connected by both movable and rigid joints that include marbles or similar spherical devices.

The bones used to build toy objects can be made of plastic, wood, or any other suitable material known to those of ordinary skill in the art. These bones can have two ends and connecting structures can be placed at one end or both ends of the bone. These connecting structures can be u-shaped yokes, split yokes, or other similar structures capable of forming a joint containing a marble or other similar spherical device. Additionally, each bone can have a spheroidal midsection that can be used to form a joint with the connecting structure of another bone. This wide variety of bone designs can allow a user to create many diverse toy structures.

In addition to standard bone designs described above, specialized bone structures can also be used that allow the user to build particular types of toy structures. For example, a specialized bone structure can be made that simulates the features of a human or animal torso. Standard bones can then be connected to this torso-like structure to create limbs and other desired features of the toy structure being built.

The marbles or other similar spherical devices, used to build the movable or rigid joints, can have a proper circumference to be securely received by a bone's connecting structure (e.g. u-shaped yoke, split yoke, etc.). These marbles or other spherical workpieces can be constructed from glass, plastic, wood, or other suitable material known to one of ordinary skill in the art.

FIG. 1 is a drawing illustrating a perspective view of a bone having a first end that includes a u-shaped yoke and a second end that includes a second u-shaped yoke, the first u-shaped yoke being in parallel to the second u-shaped yoke, according to an embodiment.

A bone 100 can be used as a structural workpiece in a toy construction apparatus. The bone 100 can include a first u-shaped yoke 101 and a second u-shaped yoke 105. Each yoke can also include two extensions 102 and each extension 102 can have a hole 103 capable of receiving a marble or other spherical device (not pictured). Each bone may also have a spheroidal midsection 104 which can be received by the u-shaped yoke of another bone (not pictured) thereby creating a movable joint connecting the two bones without the use of a marble or similar spherical device (not pictured).

Figure 2:
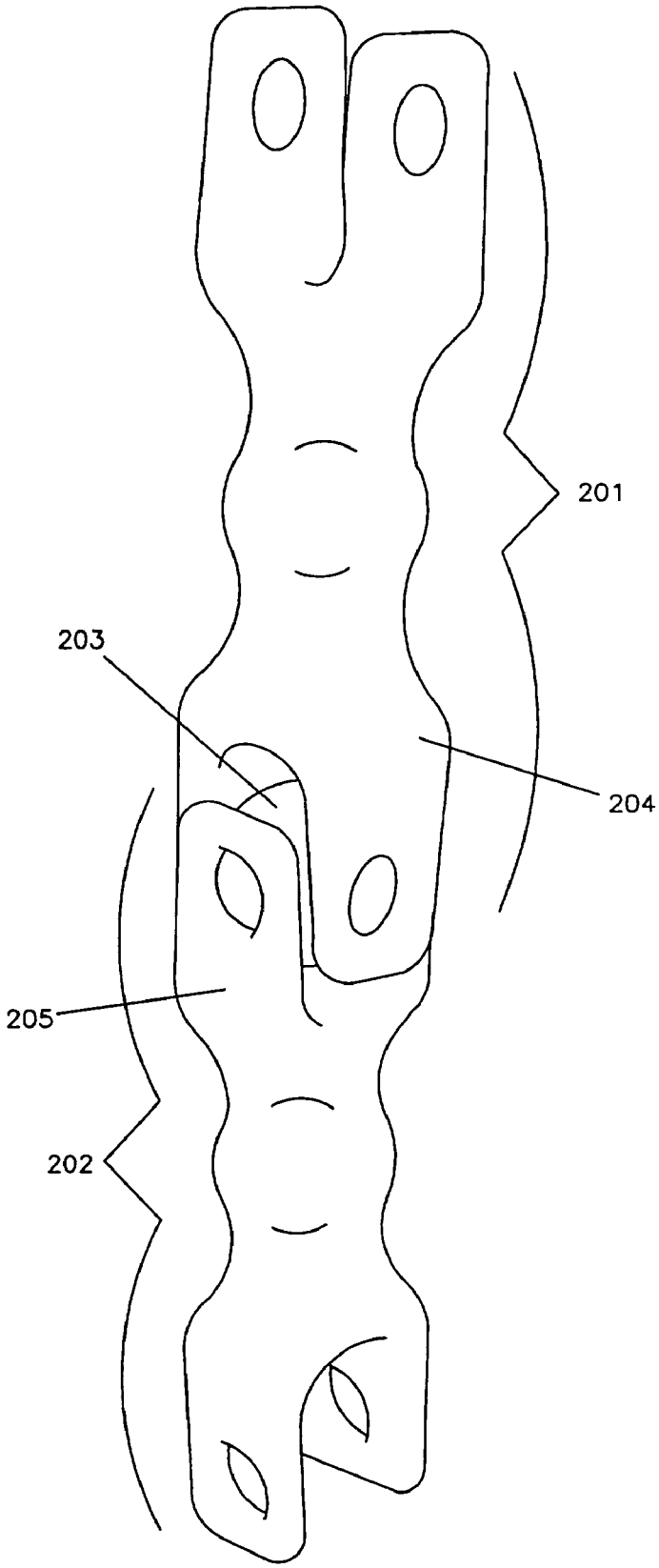
FIG. 2 is a drawing illustrating a perspective view of two bones joined together by a movable joint that includes a marble or other spherical device being received by both a first u-shaped yoke of a first bone and a second u-shaped yoke of a second bone, according to an embodiment.

FIG. 2 is a drawing illustrating a perspective view of two bones joined together by a movable joint that includes a marble or other spherical device received by a first u-shaped yoke of a first bone and a second u-shaped yoke of a second bone, according to an embodiment.

A first bone 201 can be joined to a second bone 202 by a movable joint that includes a marble 203 or other spherical workpiece. The first u-shaped yoke 204 of the first bone 201 can receive a marble 203 and a second u-shaped yoke of a second bone 202 can receive the same marble 203. The first u-shaped yoke 204 can be aligned perpendicularly to the second u-shaped yoke 205.

This movable joint allows each bone to move approximately 90 degrees forward, backward and to each side in relation to the bone to which it is attached by the movable joint.

Figure 3:
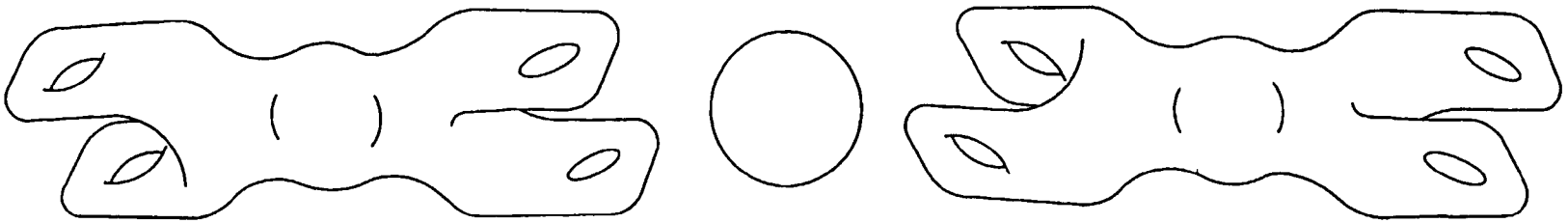
FIG. 3 is a drawing illustrating an exploded perspective view of two bones and one marble or other spherical workpiece of the apparatus depicted in FIG. 2, according to an embodiment.

FIG. 3 is a drawing illustrating an exploded perspective view of the two bones and one marble making up the apparatus depicted in FIG. 2, according to an embodiment.

Figure 4:
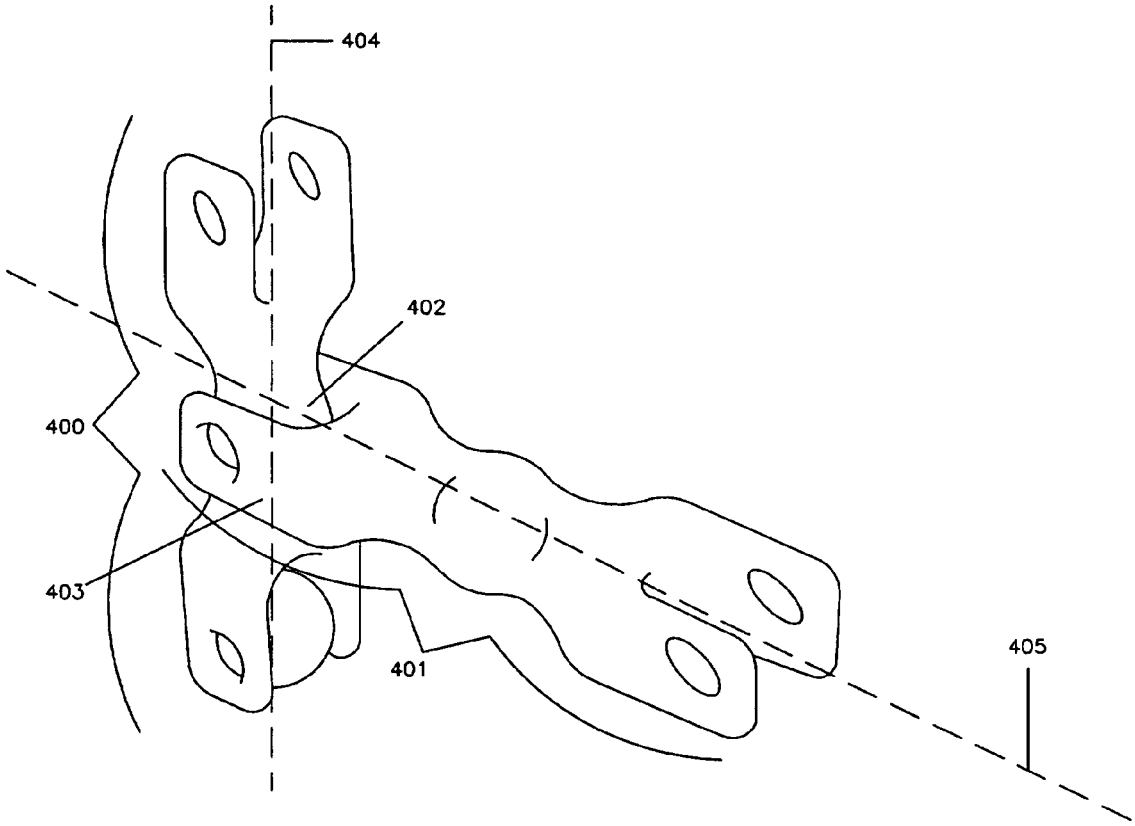
FIG. 4 is a drawing illustrating a perspective view of two bones joined together using the first u-shaped yoke of a first bone receiving a spheroidal midsection of a second bone, according to an embodiment.

FIG. 4 is a drawing illustrating a perspective view of two bones joined together using the first u-shaped yoke of a first bone receiving a spheroidal midsection of a second bone, according to an embodiment.

The first bone 400 can be connected to a second bone 401 by a movable joint formed by the spheroidal midsection 402 of the first bone 400 and the first u-shaped yoke 403 of the second bone 401. The u-shaped yoke 403 of the second bone 401 can receive the spheroidal midsection 402 of the first bone 400 by placing the extensions of the u-shaped yoke 403 on either side of the spheroidal midsection 402 so that the holes in the extensions can receive opposing sides of the spheroidal midsection 402.

The movable joint depicted in FIG. 4 can allow the second bone 401 to rotate 360 degrees about Axis A 404 and a limited amount up and down from its connection to the first bone 400 in relation to Axis B 405.

Figure 5:
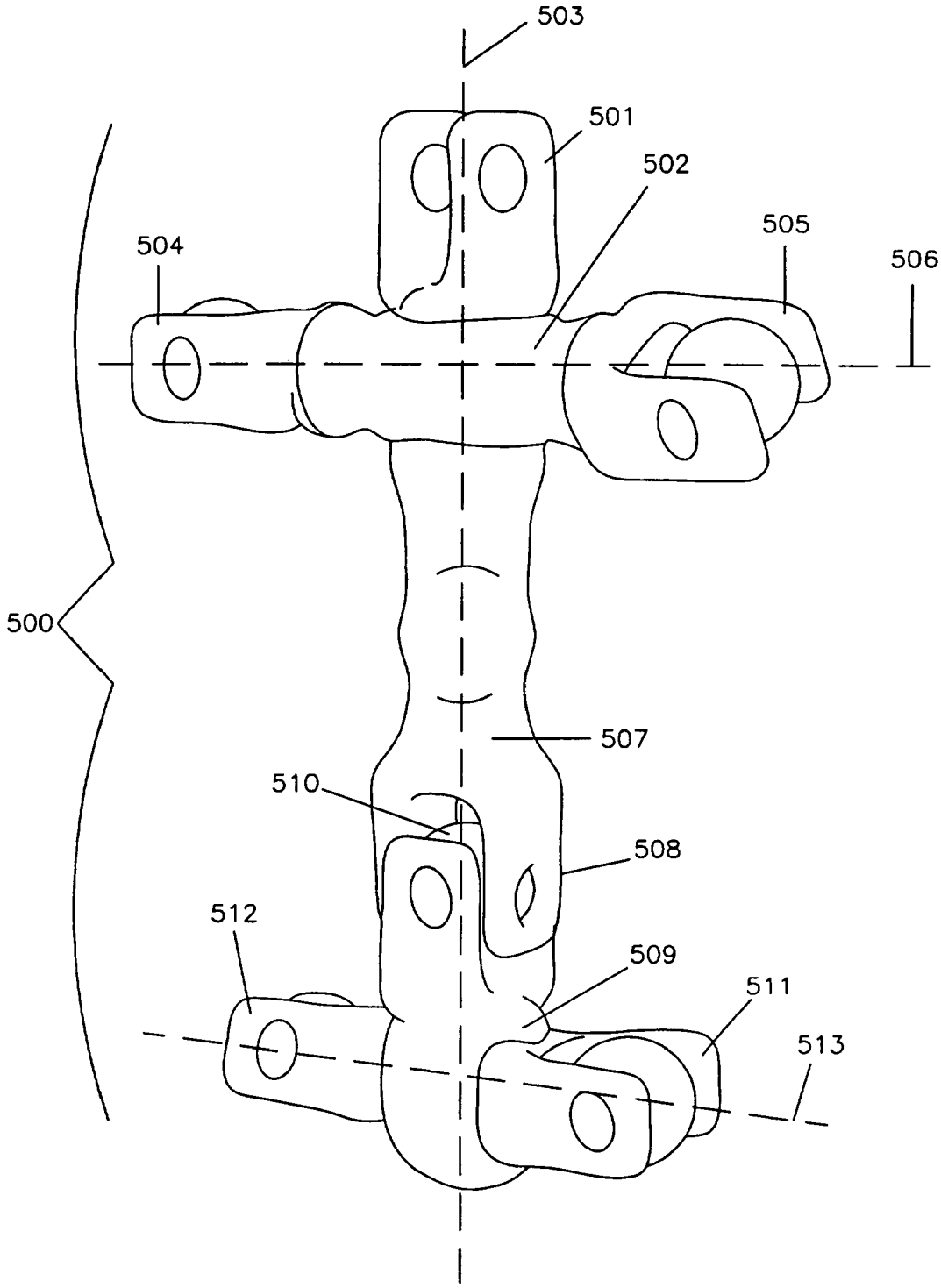
FIG. 5 is a drawing illustrating a perspective view of a torso-like toy construction apparatus capable of being joined to a plurality of bones, according to an embodiment.

FIG. 5 is a drawing illustrating a perspective view of a torso-like structural workpiece capable of being joined to a plurality of bones, or other structural workpieces, according to an embodiment.

The torso-like structural workpiece 500 can be designed to simulate the movements of the joints connecting the arms, legs, and head of a human or human-like creature to its torso. A first u-shaped yoke 501 can be attached to the upper middle point of a shoulder piece 502 creating a joint where the first u-shaped yoke 501 can move 360 degrees about Axis A 503. This first u-shaped yoke 501 can be used to form a neck-like joint where a head (not pictured) can be attached to the torso-like structural workpiece 500. Additionally, the shoulder piece 502 can have a first end having a second u-shaped yoke 504 and a second end having a third u-shaped yoke 505. Both the first and second u-shaped yokes, 504 and 505, can rotate 360 degrees about Axis B 506. These u-shaped yokes, 504 and 505, can be used to form a shoulder joint where arm-like structures can be attached to the torso-like structural workpiece 500. The torso-like structural piece can also include a backbone piece 507 having a first end and a second end. The backbone piece 507 can be perpendicularly attached at its first end, by a movable joint, to the lower middle point of the shoulder piece 502. This movable joint can allow the backbone piece 507 to move 360 degrees about Axis A 503. The second end of the backbone piece can include a u-shaped yoke 508 capable of forming a movable joint with a pelvis piece 509, which can also include a first u-shaped yoke 514, and a marble or other spherical device 510, immovably mounted onto the pelvis piece 509. This movable joint allows each bone to move approximately 90 degrees forward, backward and to each side in relation to the other bone to which it is attached by the joint. The pelvis piece 509 can also include a second u-shaped yoke 511, and a third u-shaped yoke 512, movably mounted to the sides of the pelvis piece 509. These second and third u-shaped yokes, 511 and 512, can rotate 360 degrees about Axis C 513 and can form hip joints for attaching a leg-like appendages.

Figure 6:
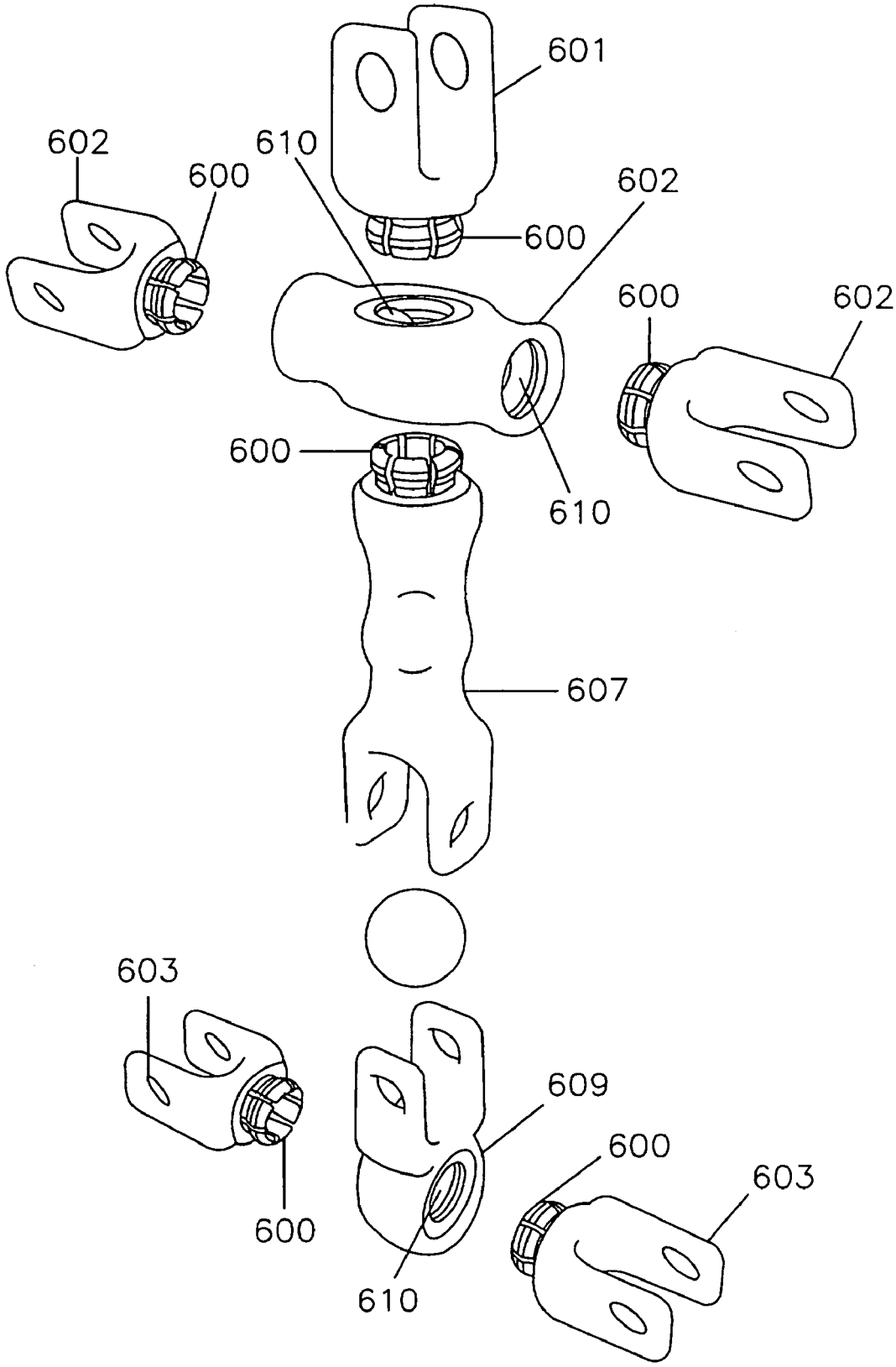
FIG. 6 is a drawing illustrating an exploded perspective view of the torso-like toy construction apparatus depicted in FIG. 5, according to an embodiment.

FIG. 6 is a drawing illustrating an exploded perspective view of a torso-like structural workpiece capable of being joined to a plurality of bones, according to an embodiment;

Attaching mechanisms 600, can be mounted to u-shaped yokes of the arms 602, legs 603, and neck 601 joints, as well as the backbone piece 607. These attaching mechanisms 600 can include a plurality of tabs that can be received by circular openings 610, securely fastening the u-shaped yokes of the arms 602, legs 603, and neck 601 joints, as well as the backbone piece 607 to the shoulder piece 602 and the pelvis piece 609. Each of these attaching mechanisms can allow the u-shaped yokes to turn 360 degrees.

Figure 7:
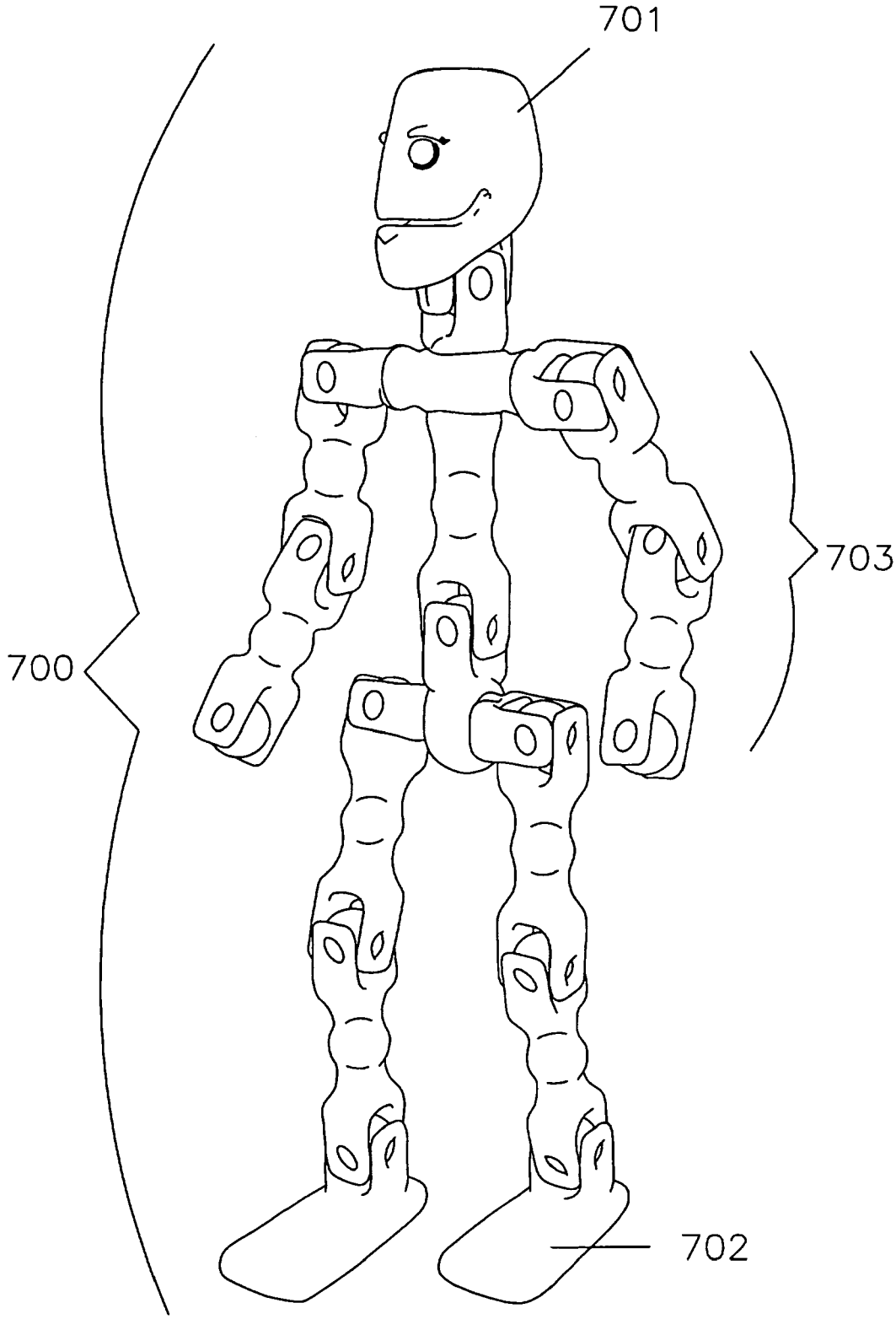
FIG. 7 is a drawing illustrating a perspective view of a human-like figure constructed with the torso-like toy construction apparatus depicted in FIGS. 5 and 6, according to an embodiment.

FIG. 7 is a drawing illustrating a perspective view of a human-like figure constructed using the torso-like toy construction apparatus depicted in FIGS. 5 and 6, according to an embodiment.

This human-like FIG. 700 can contain specialized workpieces other than the torso-like toy construction apparatus 703. The human-like FIG. 700 can also contain one or more head workpieces 701 that can also include a u-shaped yoke for forming a movable joint with any other u-shaped yoke using a marble or other spherical device. Any number of foot-like workpieces 702 can each be attached to any u-shaped yoke on the human-like FIG. 700.

Figure 8:
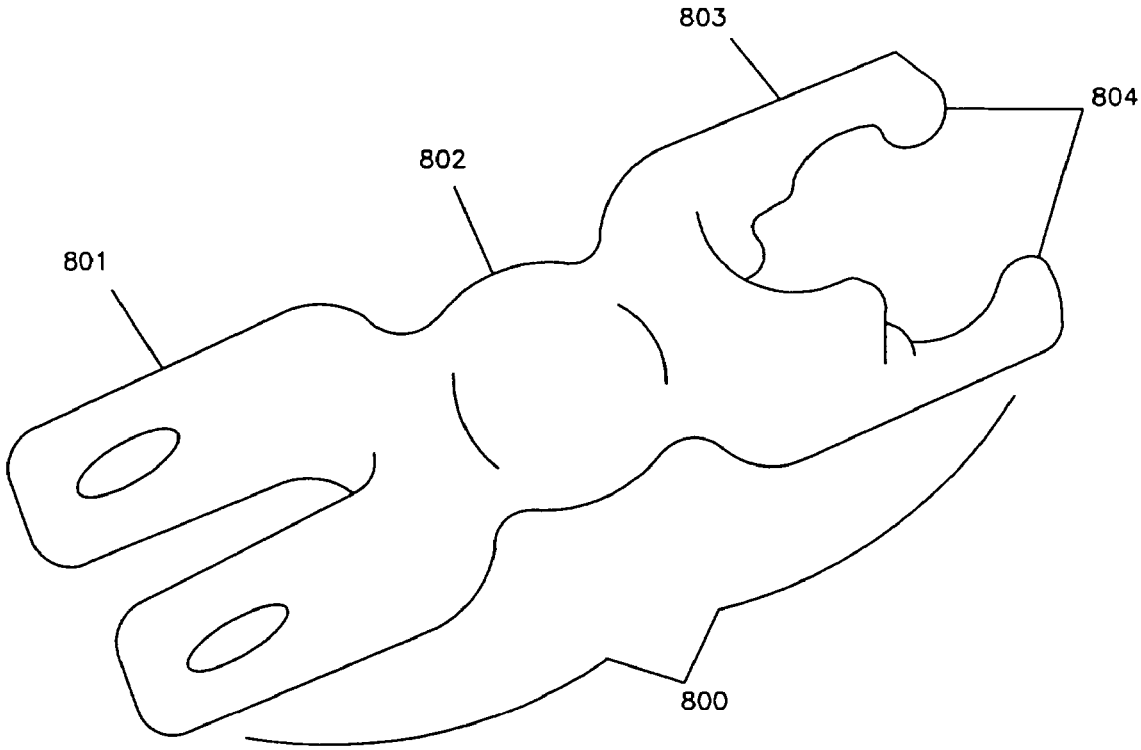
FIG. 8 is a drawing illustrating a perspective view of a bone having a first end that includes a u-shaped yoke and a second end that includes a split yoke, according to an embodiment.

FIG. 8 is a drawing illustrating a perspective view of a bone having a first end that includes a u-shaped yoke and a second end that includes a split yoke, according to an embodiment.

A bone 800 can be used as a structural workpiece in a toy construction apparatus. The bone 800 can have a first end that includes a u-shaped yoke 801 and a second end that also includes a split yoke 803. The split yoke can have two extensions 804, which can receive another split yoke (not pictured), and either a marble or other spherical device or spheroidal midsection (not pictured), to form a rigid joint. Each bone may also include a spheroidal midsection 802 which can be received by the unshaped yoke of one other bone (not pictured) or two joined split yokes of two other bones (not pictured).

Figure 9:
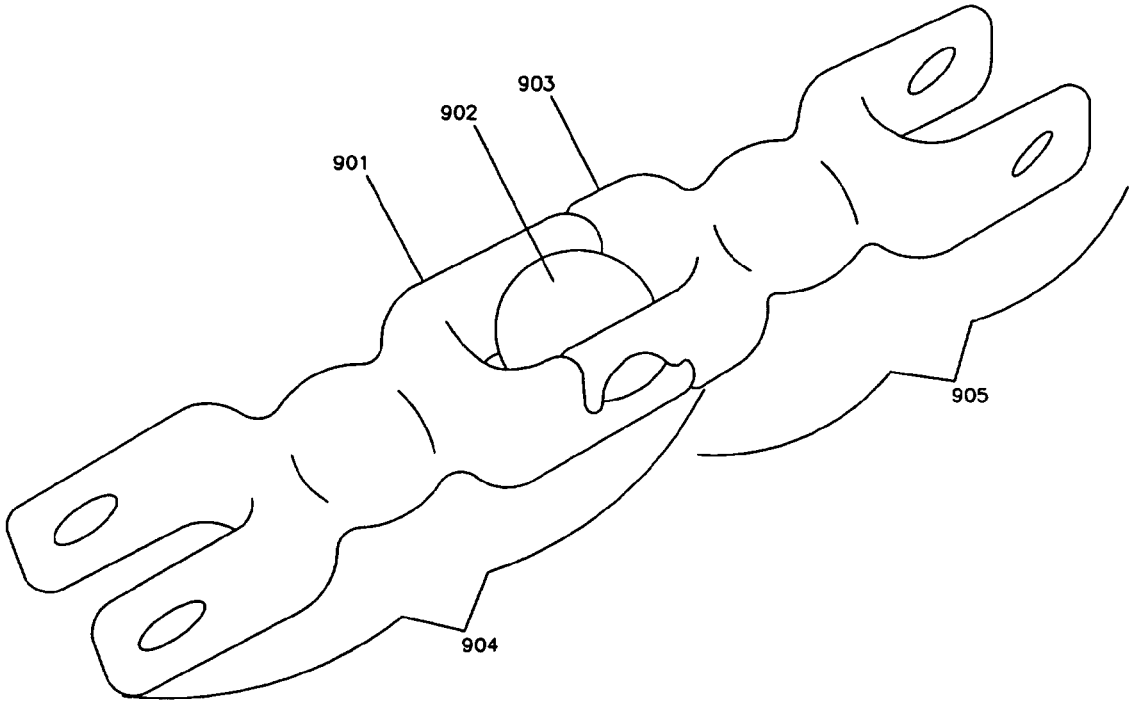
FIG. 9 is a drawing illustrating a perspective view of two bones joined together by a rigid joint that includes a marble or other spherical device received by a first split yoke of a first bone and a second split yoke of a second bone, according to an embodiment.

FIG. 9 is a drawing illustrating a perspective view of two bones joined together by a rigid joint made with a marble or other spherical device 902 received by a first split yoke 901 of a first bone 904 and a second split yoke 903 of a second bone 905, according to an embodiment.

Figure 10:
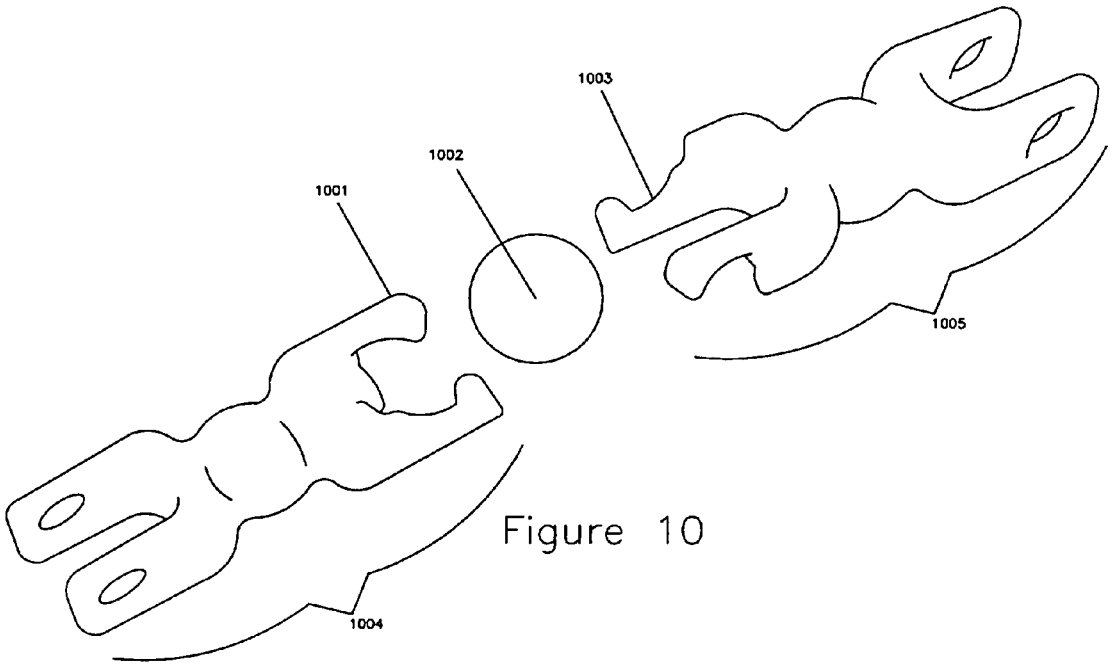
FIG. 10 is a drawing illustrating an exploded perspective view of the two bones joined together by a rigid joint comprised of a marble or other spherical device being received by a first bone having a first split yoke and a second bone having a second split yoke, as depicted in FIG. 9, according to an embodiment.

FIG. 10 is a drawing illustrating an exploded perspective view of two bones joined together by a rigid joint made with a marble or other spherical device 1002 received by a first split yoke 1001 of a first bone 1004 and a second split yoke 1003 of a second bone 1005, as depicted in FIG. 9, according to an embodiment.

Figure 11:
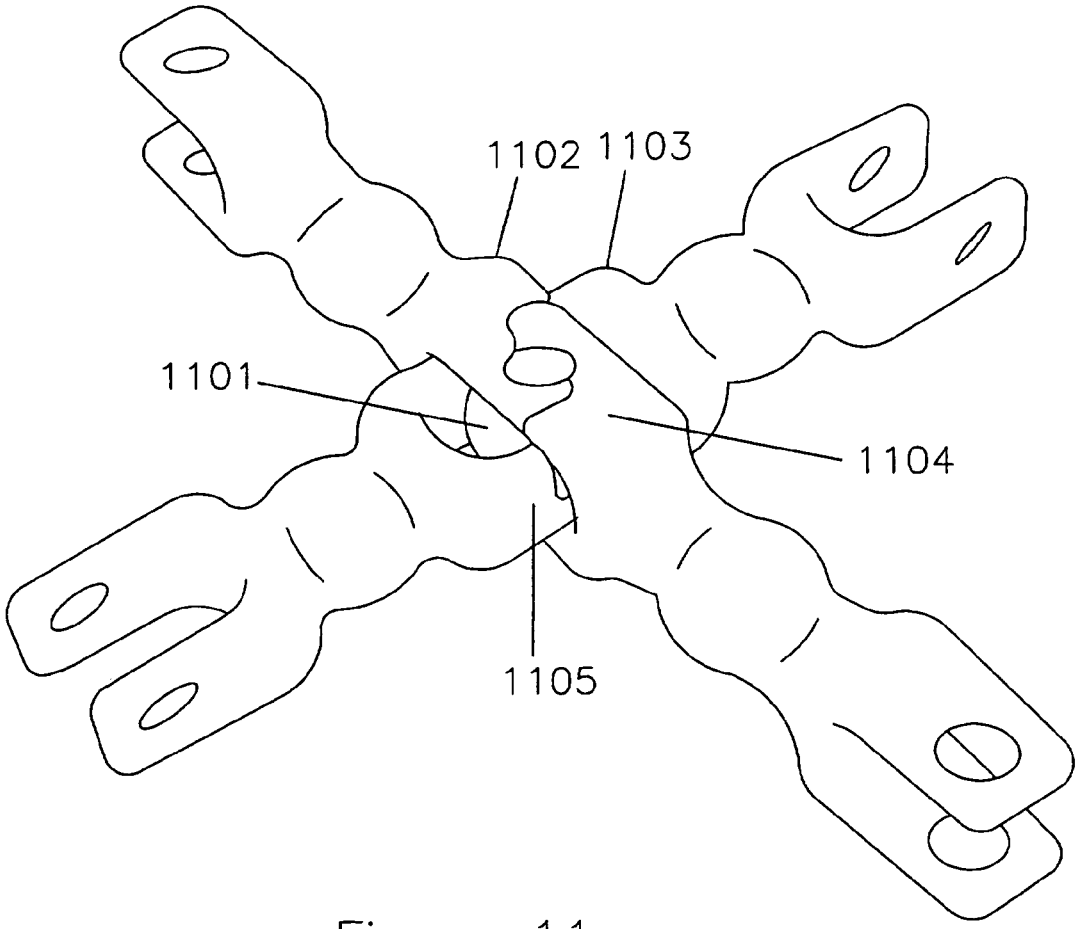
FIG. 11 is a drawing illustrating a perspective view of four bones joined together by a rigid joint that includes a single marble or other spherical device received by a first split yoke of a first bone, a second split yoke of a second bone, a third split yoke of a third bone, and a fourth split yoke of a fourth bone, according to an embodiment.
Figure 12:
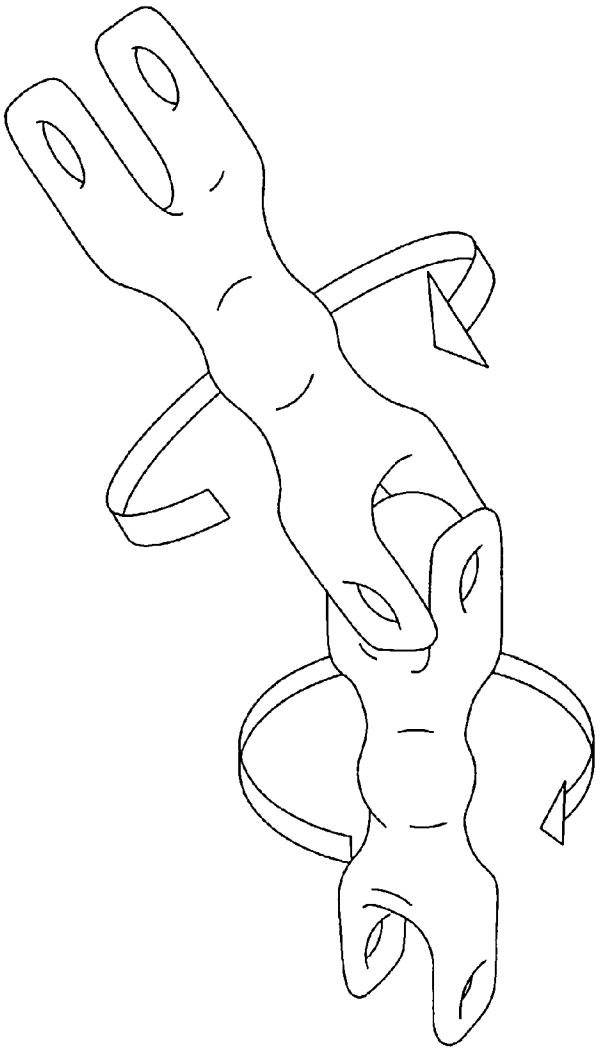
FIG. 12 is a drawing illustrating a perspective view of two bones joined together by a movable joint that includes a marble or other spherical device being received by both a first u-shaped yoke of a first bone and a second u-shaped yoke of a second bone, illustrating how such an apparatus can allow transmission of rotational forces across angles formed between the bones, according to an embodiment.
Figure 13:
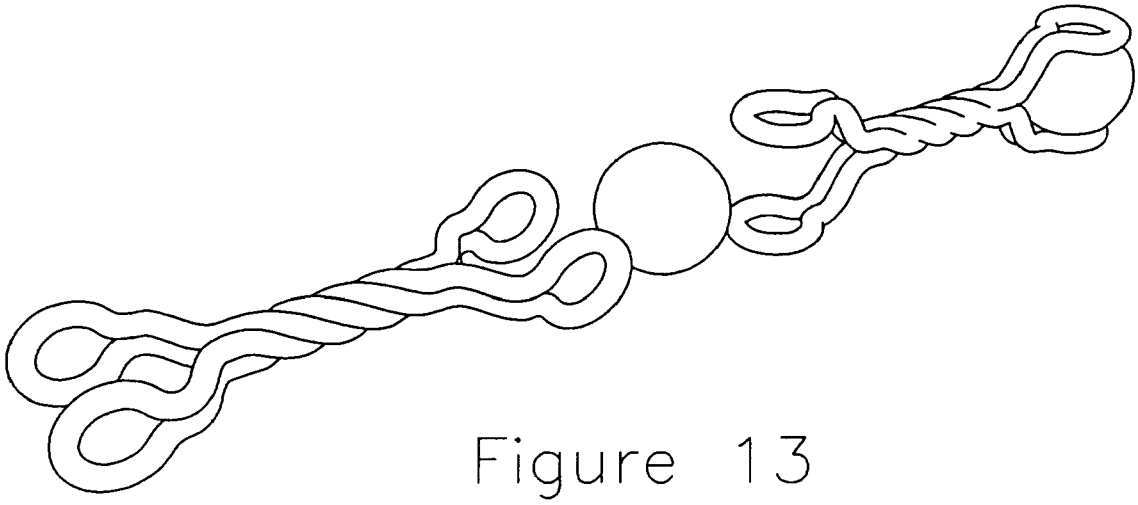
FIG. 13 is a drawing illustrating a perspective view of two bones, made from bent wire, capable of being joined together by a movable joint that includes a marble or other spherical device being received by both a first u-shaped yoke of a first bone and a second u-shaped yoke of a second bone, according to an embodiment.
Figure 14:
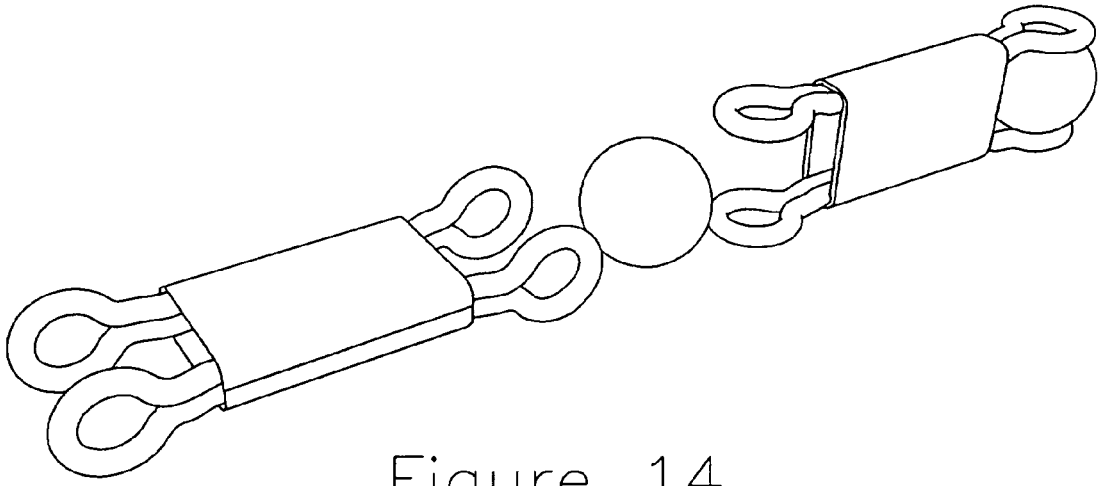
FIG. 14 is a drawing illustrating a perspective view of two bones, made from sheet metal and bent wire, capable of being joined together by a movable joint that includes a marble or other spherical device being received by both a first u-shaped yoke of a first bone and a second u-shaped yoke of a second bone, according to an embodiment.
Figure 15:
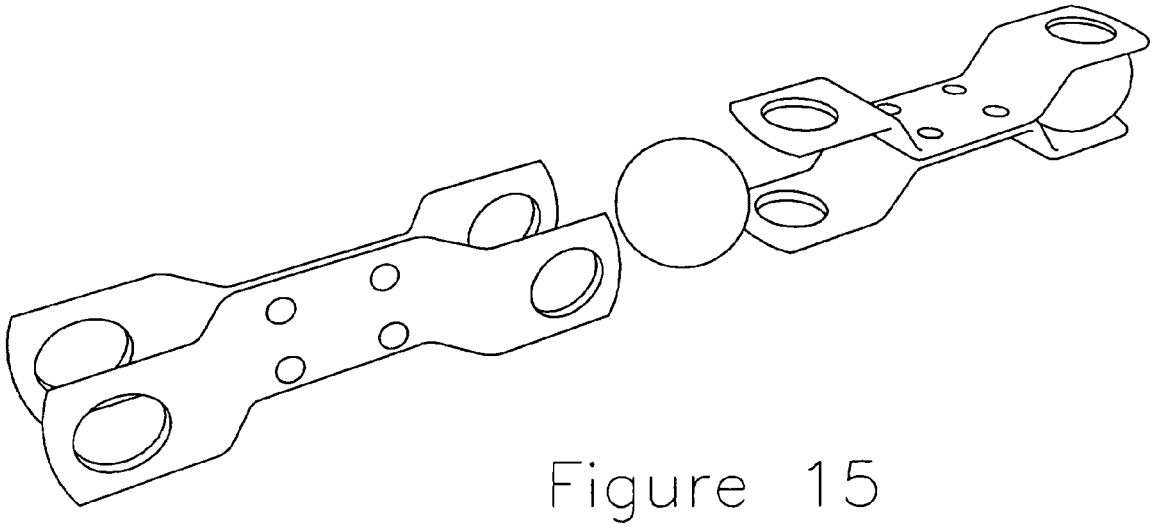
FIG. 15 is a drawing illustrating a perspective view of two bones, made from bent sheet metal, riveted or spot welded, capable of being joined together by a movable joint that includes a marble or other spherical device being received by both a first unshaped yoke of a first bone and a second u-shaped yoke of a second bone, according to an embodiment.
Figure 16:
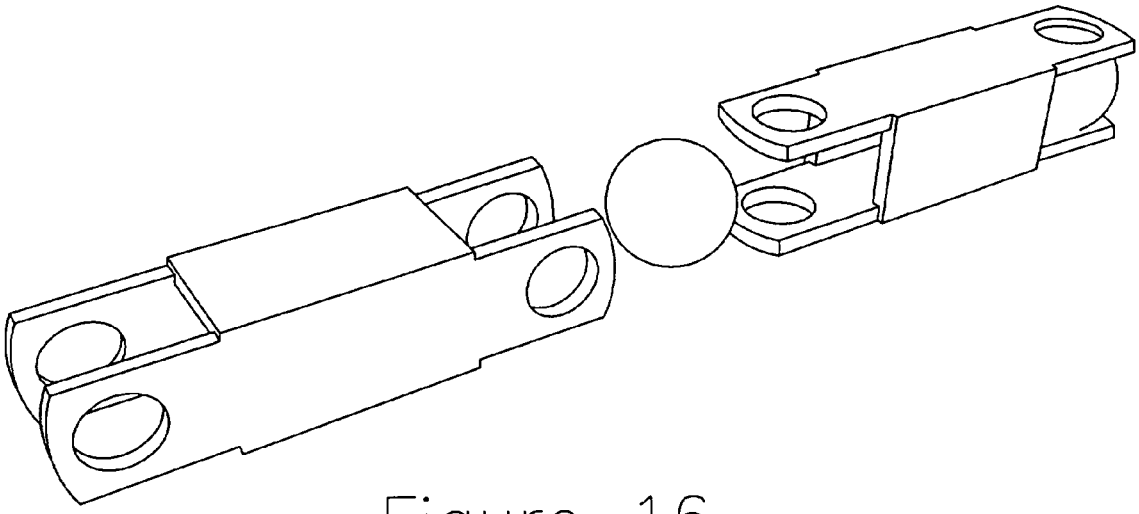
FIG. 16 is a drawing illustrating a perspective view of two bones, made from sheet metal that has been by machining or stamped extrusion, capable of being joined together by a movable joint that includes a marble or other spherical device being received by both a first u-shaped yoke of a first bone and a second u-shaped yoke of a second bone, according to an embodiment.
Figure 17:
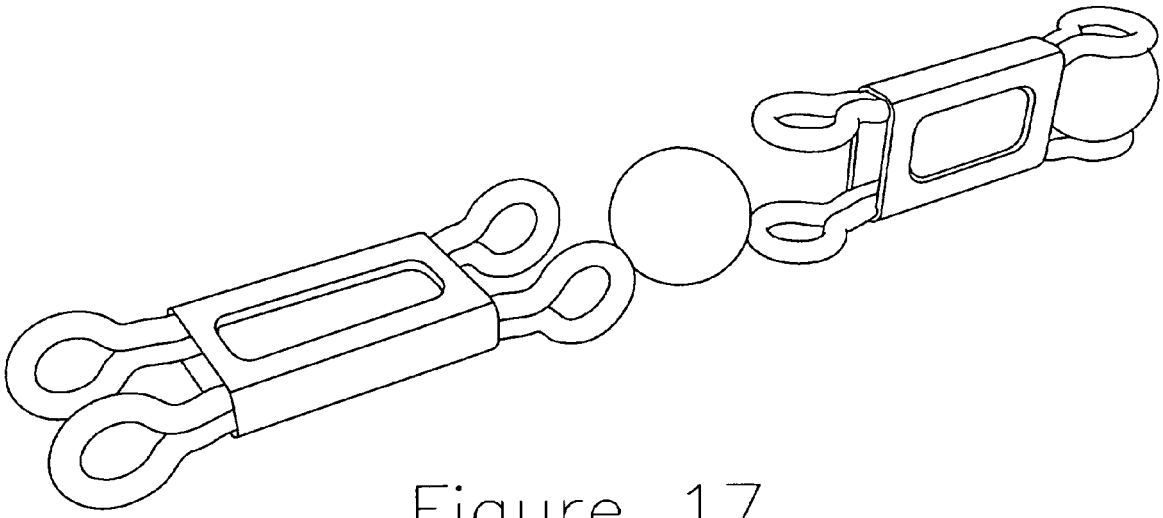
FIG. 17 is a drawing illustrating a perspective view of two bones, made from co-molded plastic over wire, capable of being joined together by a movable joint that includes a marble or other spherical device being received by both a first u-shaped yoke of a first bone and a second u-shaped yoke of a second bone, according to an embodiment.

FIG. 11 is a drawing illustrating an perspective view of four bones joined together by a rigid joint made with a single marble or other spherical device 1101 received by a first split yoke of a first bone 1102, a second split yoke of a second bone 1103, a third split yoke of a third bone 1104, and a fourth split yoke of a fourth bone 1105, according to an embodiment.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A toy construction apparatus, the apparatus comprising:

a. at least one structural piece having a first end and a second end, wherein the first end includes a u-shaped yoke comprising first and second substantially planar arms in substantially parallel alignment; and b. at least one isolated substantially spherical device, wherein the spherical device has a circumference sufficient to enable the spherical device to be releasably engaged between the first and second planar arms, and wherein the first and second substantially planar arms further comprise openings for releasably engaging the spherical device.

2. The toy construction apparatus as recited in claim 1 further comprising a spheroidal midsection, wherein the spheroidal midsection has a circumference sufficient to enable the spheroidal midsection to be releasably engaged between the first and second planar arms of a u-shaped yoke of a second toy construction apparatus.

3. A toy construction apparatus comprising a torso member, wherein the torso member comprises:

a. a first end including a first u-shaped yoke comprising two generally planar and parallel disposed arms for releasably receiving an isolated spherical device or a spheroidal device;

b. a generally perpendicularly-disposed shoulder piece having a first end, a second end and a midsection, wherein the first and second ends of the shoulder piece include second and third u-shaped yokes respectively attached to the first and second ends of the shoulder piece, the u-shaped yokes comprising generally planar and parallel disposed arms for releasably receiving a spherical device or a spheroid device, and the midsection includes the first u-shaped yoke attached thereon; and c. a second end comprising of a fourth u-shaped yoke comprising two generally planar and parallel disposed arms for releasably receiving a spherical device or a spheroidal device.

4. The toy construction apparatus as recited in claim 3 further comprising a pelvis member for releasable engagement with the second end of the torso member, the pelvis member comprising a first end, a second end and a midsection, wherein the first and second ends each include fifth and sixth u-shaped yokes respectively comprising first and second substantially planar arms in substantially parallel alignment for releasably receiving an isolated substantially spherical device, and the midsection includes a seventh u-shaped yoke substantially perpendicularly disposed from the midsection, the seventh u-shaped yoke comprising first and second substantially planar arms in substantially parallel alignment for releasably receiving a second isolated substantially spherical device.

5. The toy construction apparatus as recited in claim 3 further comprising at least one structural piece for releasable attachment to the torso member and at least one isolated substantially spherical device, wherein the structural piece comprises a first end and a second end, wherein the first end includes a u-shaped yoke comprising first and second substantially planar arms in substantially parallel alignment; and wherein the spherical device has a circumference sufficient to enable the spherical device to be releasably engaged between the first and second planar arms of any of the u-shaped yokes.

6. The toy construction apparatus as recited in claim 5 wherein the first and second substantially planar arms of the u-shaped yokes further comprise openings for releasably engaging the spherical device.

7. The toy construction apparatus as recited in claim 5 wherein the structural piece further comprises a spheroidal midsection, wherein the spheroidal midsection has a circumference sufficient to enable the spheroidal midsection to be releasably engaged between the first and second planar arms of a u-shaped yoke of a second toy construction apparatus.

8. The toy construction apparatus as recited in claim 5 comprising:

a. a plurality of structural pieces;

b. a plurality of isolated spherical devices;

c. a pelvis member for releasable engagement with the second end of the torso member, the pelvis member comprising a first end, a second end and a midsection, wherein the first and second ends each include fifth and sixth u-shaped yokes respectively comprising first and second substantially planar arms in substantially parallel alignment for releasably receiving an isolated substantially spherical device, and the midsection includes a seventh u-shaped yoke substantially perpendicularly disposed from the midsection, the seventh u-shaped yoke comprising first and second substantially planar arms in substantially parallel alignment for releasably receiving a second isolated substantially spherical device;

d. at least one foot-like workpiece comprising a planar foot section and an eighth u-shaped yoke comprising first and second substantially planar arms in substantially parallel alignment for releasably receiving an isolated substantially spherical device; and e. a head-like workpiece comprising a generally oval head piece and a ninth u-shaped yoke comprising first and second substantially planar arms in substantially parallel alignment for releasably receiving an isolated substantially spherical device.

9. The toy construction apparatus as recited in claim 5 wherein the second end of the structural piece includes a u-shaped yoke comprising first and second substantially planar arms in substantially parallel alignment for releasably receiving a second isolated substantially spherical device.

10. The toy construction apparatus as recited in claim 9 wherein the first and second substantially planar arms further comprise openings for releasably engaging the spherical device.

* * * * *